US009249743B2

(12) United States Patent
Korenchan

(10) Patent No.: US 9,249,743 B2
(45) Date of Patent: Feb. 2, 2016

(54) INJECTOR NOZZLE COKING COMPENSATION STRATEGY

(75) Inventor: James E. Korenchan, Burr Ridge, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 335 days.

(21) Appl. No.: 14/005,263

(22) PCT Filed: Mar. 18, 2011

(86) PCT No.: PCT/US2011/028968

§ 371 (c)(1), (2), (4) Date: Sep. 14, 2013

(87) PCT Pub. No.: WO2012/128741

PCT Pub. Date: Sep. 27, 2012

(65) Prior Publication Data

US 2014/0000566 A1 Jan. 2, 2014

(51) Int. Cl.

| | |
|---|---|
| ***F02D 41/00*** | (2006.01) |
| ***F02M 57/00*** | (2006.01) |
| ***F02D 41/24*** | (2006.01) |
| *F02D 41/22* | (2006.01) |

(52) U.S. Cl.

CPC ..... *F02D 41/00* (2013.01); *F02D 41/2467* (2013.01); *F02M 57/005* (2013.01); *F02D 2041/224* (2013.01); *F02D 2200/0602* (2013.01); *F02D 2200/0614* (2013.01); *F02M 2200/06* (2013.01); *F02M 2200/24* (2013.01); *F02M 2200/247* (2013.01)

(58) Field of Classification Search

CPC ... F02D 41/00; F02D 41/182; F02D 41/2467; F02D 2041/224; F02M 51/00; F02M 51/0667; F02M 47/022; F02M 47/027; F02M 2200/24; F02M 2200/06; F02M 2200/062; F02M 2200/247; F02M 57/00; F02M 57/005

See application file for complete search history.

(56) References Cited

U.S. PATENT DOCUMENTS 3,712,275 A * 1/1973 Jackson ..... F02D 41/182 123/483
4,068,640 A * 1/1978 Watson ..... F02M 47/022 123/450

(Continued)

OTHER PUBLICATIONS

The State Intellectual Property Office of the People's Republic of China, Notice on the First Office Action, Apr. 24, 2015.

*Primary Examiner* — Hieu T Vo

(74) *Attorney, Agent, or Firm* — Mark C. Bach; Jeffrey P. Calfa

(57) ABSTRACT

Systems and methods for compensating for nozzle coking in fuel injection system include creating expected fuel flow rate formula for selected fuel injection nozzle, operating selected fuel injection nozzle for a time, measuring fuel pressure and injector control valve on-time of fuel injection nozzle during operation, determining expected fuel flow rate for measured fuel pressure and injector control valve on-time, measuring actual fuel flow rate of fuel injection nozzle, determining coking condition of fuel injection nozzle, and automatically altering injector control valve on-time to compensate. Expected fuel flow rate formula is determined as function of fuel pressure and injector control valve on-time, while actual fuel flow rate is measured by flow rate sensor attached to injection system. Sometimes, coking condition determination is based on difference between actual fuel flow rate and expected flow rate. Compensation in control valve on-time is necessitated by deterioration in actual fuel flow to cylinder.

22 Claims, 3 Drawing Sheets

(56) References Cited

U.S. PATENT DOCUMENTS 5,445,019 A 8/1995 Glidewell et al.
2011/0023851 A1 2/2011 Johnson
2011/0030635 A1 2/2011 Siuchta

* cited by examiner

INJECTOR NOZZLE COKING COMPENSATION STRATEGY

TECHNICAL FIELD OF THE INVENTION

The present device relates to a fuel-injection system using high-efficiency (HE) injection nozzles. Particularly, the present device relates to an a HE fuel-injection nozzle coking compensation strategy.

BACKGROUND OF THE INVENTION

Fuel systems typically employ multiple closed-nozzle fuel injectors to inject high pressure fuel into the combustion chambers of an engine. Each of these fuel injectors includes a nozzle assembly having a cylindrical bore with a nozzle supply passageway and a nozzle outlet. The efficiency of the nozzle outlet or orifice is a measure of how effectively the energy stored in the fuel as pressure is converted into kinetic energy. The greater the kinetic energy, the more the fuel is broken apart (atomized), improving combustion completeness and lowering soot. High-efficiency (HE) nozzles, i.e., those with the highest orifice efficiency, are desirable for emissions.

Unfortunately, HE nozzles also have a greater propensity to exhibit coking, or injector spray hole fouling, which is the deposition of coked fuel layers on the orifice wall (internal) and on the outside surface of the nozzle tip (external). The flow rate of a coked nozzle is reduced because of the added restriction to the flow. As rated injection pressures of new injection systems increase to further provide emission benefits, it has become increasingly difficult to design HE nozzles without coking.

Coking is when the byproducts of combustion accumulate on or near the injector nozzle openings. As the deposits build up, they can clog the injector nozzle orifices and adversely affect the performance of the fuel injectors. This can lead to reduced fuel economy and can increase the amount of pollutants released into the atmosphere through exhaust.

To date, the problem of coking has been addressed by engine manufactures seeking nozzle designs that avoid flow rate losses, deemed unacceptable when the loss is more than about three percent. One method for maintaining high nozzle efficiency without coking has been to minimize the spray hole aspect ratio (L/D)—the ratio of the spray hole length (L) to the spray hole exit diameter (D). The ability to further decrease spray hole length (L) is constrained by the allowable stresses in the nozzle metal as injection pressure increases. The ability to further increase spray hole exit diameter (D) is constrained by the nozzle flow rate and the number of holes that are best for emissions for a given engine application. Other methods, such as increasing spray hole internal roughness or making subtle changes in spray hole geometry, provide only marginal improvements to reduce coking.

The device of the present disclosure is directed to overcoming the problems set forth above, but in a way previously unappreciated by those skilled in the art. The present device provides a unique operation strategy which makes use of HE nozzles and requires few additional components over those currently used in fuel injection systems. The device and methods of the present invention recognize and take advantage of two previously unappreciated facts: (1) flow rate loss due to coking will eventually stabilize after sufficient service time, and (2) good emission performance can be maintained even with coked nozzles.

SUMMARY OF THE INVENTION

There is disclosed herein an improved fuel injection nozzle system and control strategy which avoids the disadvantages of prior devices while affording additional structural and operating advantages. The disclosed device and methods compensate for nozzle coking in a fuel injection system, particularly where high-efficiency nozzles are used.

In an embodiment of the disclosed method for compensating for nozzle coking in a fuel injection system, the method includes the steps of creating an expected fuel flow rate formula for a selected fuel injection nozzle, operating the selected fuel injection nozzle for a period of time, measuring fuel pressure and injector control valve on-time of the fuel injection nozzle during operation, determining the expected fuel flow rate for the measured fuel pressure and injector control valve on-time, measuring an actual fuel flow rate of the fuel injection nozzle, determining a coking condition of the fuel injection nozzle, and automatically altering the injector control valve on-time to compensate.

The expected fuel flow rate formula is empirically determined as a function of fuel pressure and injector control valve on-time, while the actual fuel flow rate is measured by a flow rate sensor attached to the fuel injection system. Accordingly, for the disclosed embodiment, determination of a coking condition is based on a difference between the actual fuel flow rate and the expected fuel flow rate. Compensation in the control valve on-time is as a result of the deterioration in the actual fuel flow rate.

In an embodiment of the invention, the disclosed compensation method using the expected fuel flow rate formula is integrated in an engine control strategy. Likewise, the altering of the injector control valve on-time may also be made part of the engine control strategy.

Generally speaking, the disclosed fuel injection system includes a fuel source, a fuel injection nozzle fed by the fuel source, a control valve connected between the fuel source and the injection nozzle, a fuel flow rate sensor, a fuel pressure sensor, a control valve on-time sensor, and a control circuit electronically connected to each of the fuel flow sensor, pressure sensor, the control valve on-time sensor and the control valve.

In an embodiment of the disclosed device the control circuit alters the control valve on-time when the actual fuel flow rate is different than an expected fuel flow rate based on the measured fuel pressure and measured control valve on-time. This difference is also an indication of the coking status of the particular injection nozzle. As such, high-efficiency nozzles are particularly useful in embodiments of the present system.

Methods for creating a fuel injection nozzle control strategy are also disclosed where, in select embodiments, a specific fuel injection nozzle configuration is to be controlled. The method includes determining expected fuel flow rate for the selected fuel injection nozzle, operating the selected fuel injection nozzle for a period of time, measuring fuel pressure and injector control valve on-time of the fuel injection nozzle, measuring the actual fuel flow rate of the fuel injection nozzle during operation, determining a coked nozzle condition of the fuel injection nozzle, and altering the injector control valve on-time to compensate for the coked nozzle.

In an embodiment of the disclosed method, the calculating of any difference and the altering of the injector control valve on-time are performed by an engine control circuit. The step of determining a coked nozzle condition may include the step of calculating any difference, typically a deficit, between the actual fuel flow rate and the expected fuel flow rate corresponding to the measured fuel pressure and injector control valve on-time for the fuel injection nozzle.

These and other aspects of the invention may be understood more readily from the following description of certain embodiments.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
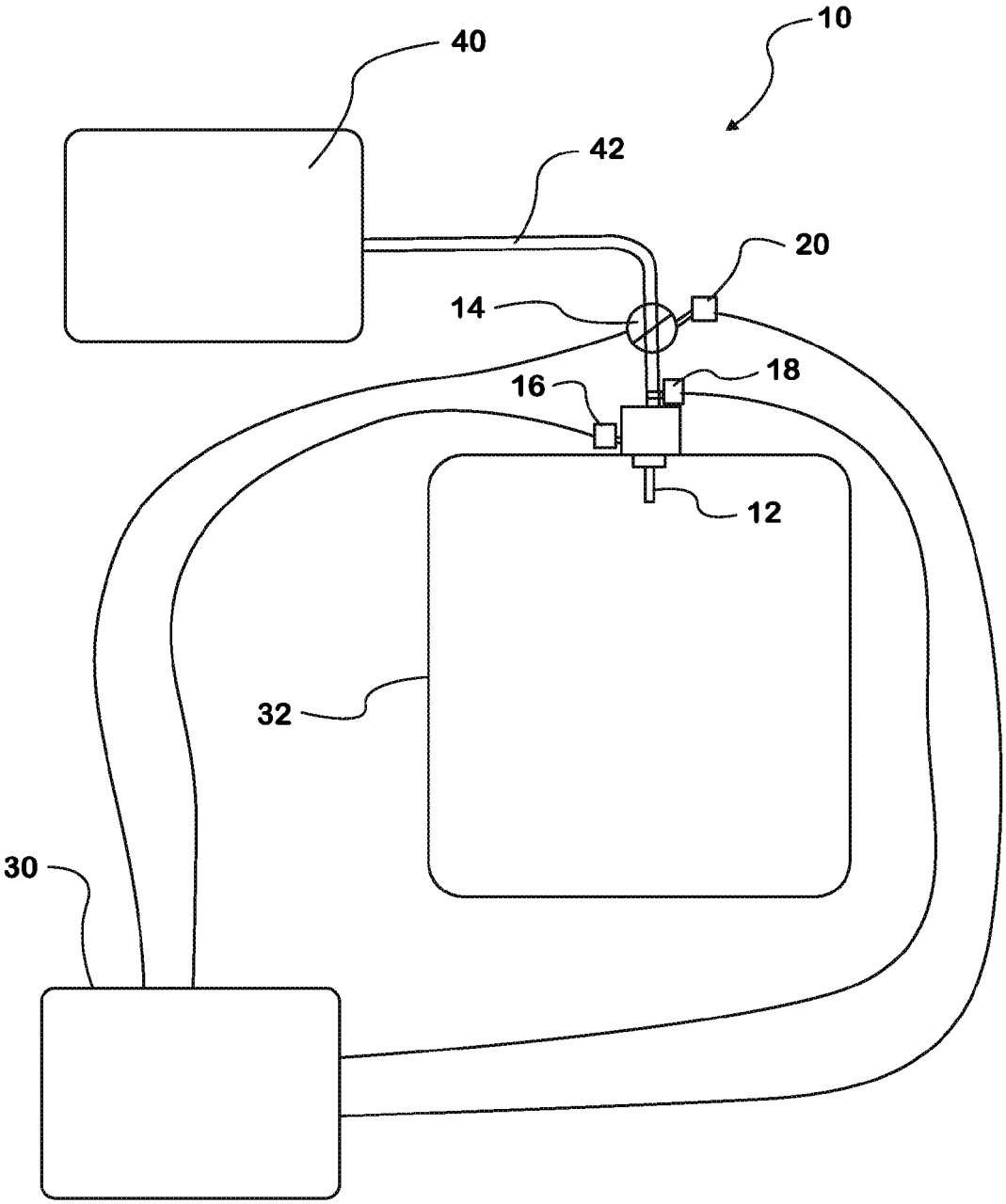
FIG. 1 is a schematic illustration of an embodiment of the disclosed fuel injection system.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Figure 2:
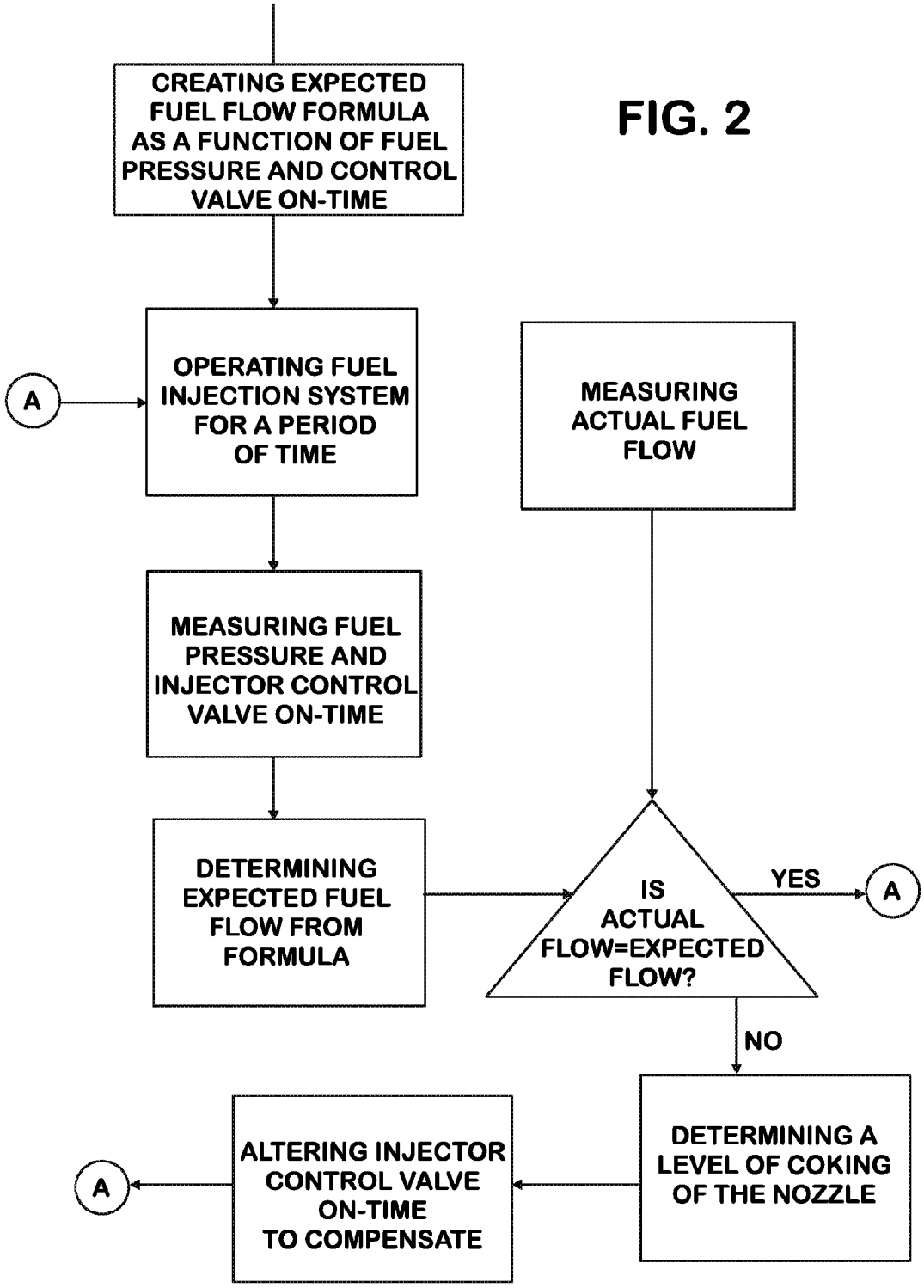
FIG. 2 is a flow chart illustrating an embodiment of the present compensation strategy.
Figure 3:
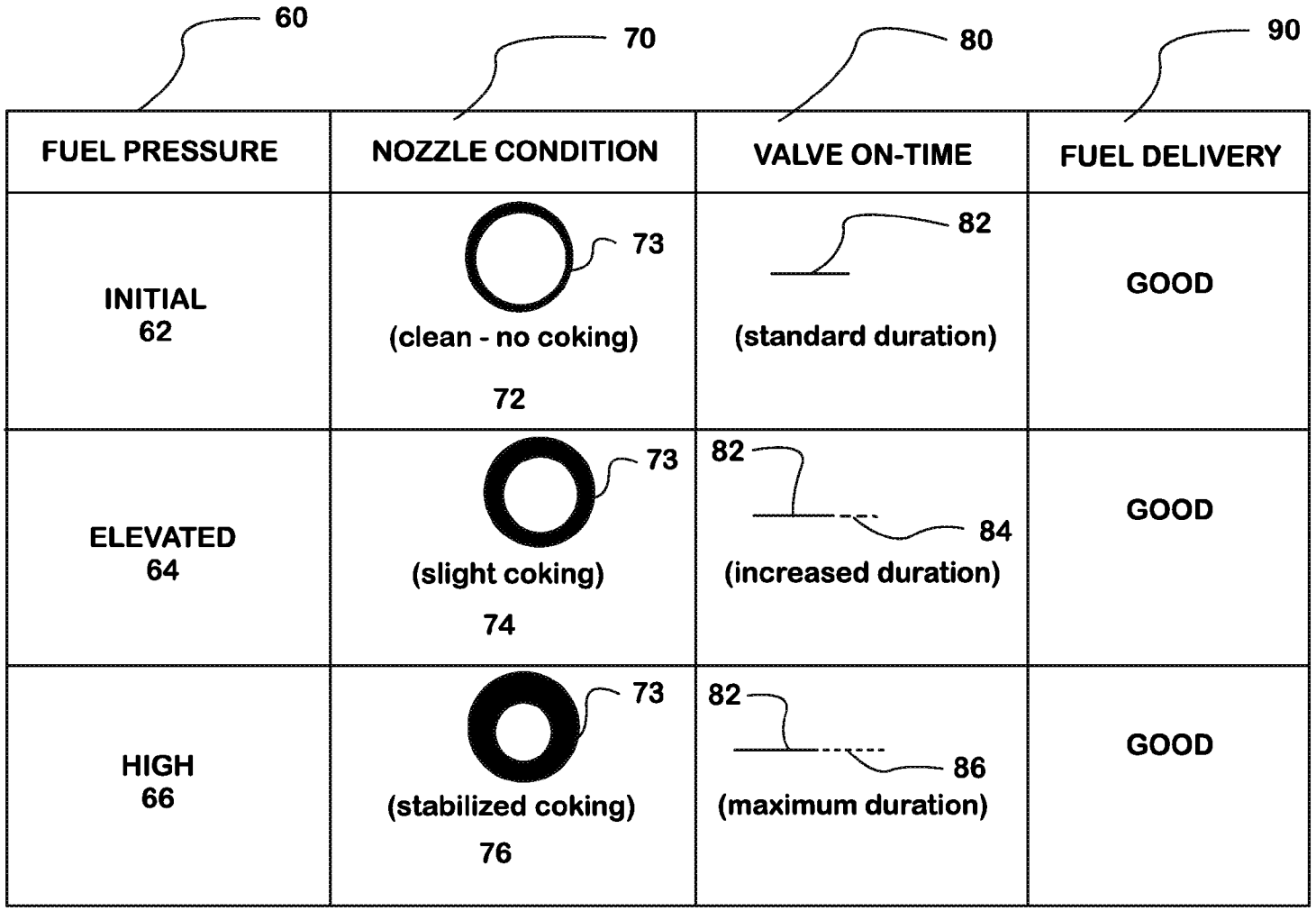
FIG. 3 is a chart illustrating an aspect of the coking compensation strategy of an embodiment of the present invention.

Referring to FIGS. 1-3, there is illustrated embodiments of both methods for creating an injector nozzle coking compensation strategy and a fuel injection nozzle system, generally designated by the numeral 10. The methods and systems are not limited to any particular type of injection nozzle, though high-efficiency nozzles are particularly useful.

Generally speaking, with reference to the drawing of FIG. 1, the fuel injection system 10 includes a fuel source 40, a fuel injection nozzle 12, a control valve 14, a fuel flow rate sensor 16, a pressure sensor 18, a control valve on-time sensor 20, and control circuit 30. As shown, the fuel injection nozzle 12 is fed fuel by the fuel source 40, which is generally a fuel tank and an adjoining fuel line 42. The injection nozzle 12 discharges fuel at an initial flow rate into an engine cylinder 32. The fuel flow is controlled by a valve 14 connected between the fuel source 40 and the injection nozzle 12. By opening for a duration of time, the control valve 14 is capable of delivering a requisite amount of fuel, at a known fuel pressure, to the engine cylinder 32. Through the performance of empirical studies, a fuel flow rate formula can be derived for any fuel nozzle type. The formula, which can be made part of the engine control strategy, is derived as a function of both fuel pressure and control valve on-time. As such, the formula can be used to determine an expected fuel flow into an engine cylinder based on measured fuel pressure and control valve on-time.

The injection nozzle 12 may be most any suitable nozzle type. However, the high-efficiency nozzles are particularly useful for most engines, yet they are also particularly prone to coking. This coking tendency actually makes the high-efficiency nozzles also particularly appropriate for use with the present compensation system and methods.

To determine the fuel pressure and control valve on-time variables for the present system embodiment, sensors already employed in most engines are useful. The fuel pressure sensor 18 and control valve on-time sensor 20 are electronically connected to an engine system control circuit 30. The engine control strategy, e.g., see FIGS. 2 and 3 described below, is also incorporated into the control circuit 30.

The addition of a fuel flow rate sensor 16 to the system is used to measure the actual fuel flow into the engine cylinder 32. The fuel flow sensor 16 is also electronically connected to the control circuit 30. When the control circuit 30 determines that the actual fuel flow rate is different than the expected fuel flow rate, as determined from the measured control valve on-time and fuel pressure, the control valve on-time can be altered or adjusted to compensate. A comparator may be used as part of the control circuit 30 to compare the expected and actual fuel flow for the injection system. A deficit in the actual fuel flow (as compared to the expected fuel flow) represents a condition of the fuel system, particularly the condition of the injection nozzle due to coking.

Referring now to the flow chart of FIG. 2, a disclosed embodiment is directed to compensating for nozzle coking in a fuel injection system. The steps of the method are set forth in the boxes of the flow chart. The disclosed method begins with the creation of an expected fuel flow rate formula. The formula is empirically derived and is expressed as a function of both fuel pressure and control valve on-time. The derived formula would also be for a particular selected fuel injection nozzle type. That is, each type of fuel injection nozzle would require a fuel flow rate formula, as each operates differently and may coke differently as well. The fuel flow rate formula may be used to calculate an expected fuel flow rate given a fuel pressure and a control valve on-time for the respective injection nozzle.

Once the fuel flow rate formula is created, it may be made part of the engine control strategy. Then, as the engine operates with the selected fuel injection nozzle for a period of time, measurements of fuel pressure and injector control valve on-time of the fuel injection nozzle can be made. Such a process step would not require additional components, as both variables are already monitored in all current engines using standard pressure sensors and timing sensors, as necessary. From the measured fuel pressure and injector control valve on-time, an expected fuel flow rate can be determined for the selected injection nozzle based on the created fuel flow rate formula.

Whether performed simultaneous to other system variable measurements or sequentially (i.e., before or after), the actual fuel flow rate of the fuel injection nozzle can be measured. A commercially available fuel flow rate sensor may be added to the system, as described above. The actual and expected fuel flow rates are then compared to determine a difference, if any. Of course, a standard for the difference can be set to be sure any calculated difference is significant. Further, redundant measures can also be made to minimize the possibility of anomalies in the measured variables. If no difference exists between the actual and expected fuel flow rates, then engine operation continues unchanged and the monitoring steps are repeated. However, a gradual change (i.e., a deterioration) in the actual flow rate relative to the expected flow rate is considered to represent the condition of the fuel injection system, especially the condition of the injection nozzle due to coking. As the flow rate diminishes, the amount of fuel being delivered to the engine cylinder is likewise reduced, resulting in power and efficiency losses.

However, instead of eliminating the coking condition of the injection nozzle, the system of the present embodiment automatically alters the duration of the injector control valve on-time to compensate for deterioration in the actual fuel flow rate. That is, as the nozzle becomes coked and the flow of fuel is reduced as a result, the control valve is opened for a longer period to maintain the necessary amount of fuel being delivered to the engine cylinder. Eventually, the nozzle coking condition stabilizes and additional adjustments of the control valve on-time are unnecessary.

One embodiment of this strategy is illustrated in the chart of FIG. 3. In the first column 60 of the chart, the relative fuel pressure is indicated as either "INITIAL" 62, "ELEVATED" 64 or "HIGH" 66. The latter two designations are to be understood as being relative to the initial fuel pressure, which is considered a baseline for a fuel injection nozzle type. The second column 70 is illustrative of three distinct nozzle conditions: clean 72, slight coking 74, and stabilized coking 76. The inner circle 73 in each cell of the second column 70 is illustrative of the nozzle orifice and is shown to be more restricted as the coking condition progresses. There may, of course, be any number of intermediate conditions represented by the three entries. The third column 80 is merely a representation of the control valve on-time. In the first cell, the standard duration (in time increments) is represented by a solid line 82. In the second cell, the standard duration 82 is extended, as represented by the broken line 84. Finally, in the third cell, the standard duration 82 is extended an even greater time, as represented by the longer broken line 86. Finally, the fourth column 90 indicates fuel delivery is substantially unchanged as a result of the compensation strategy.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A method for compensating for nozzle coking in a fuel injection system, the method comprising the steps of:

creating an expected fuel flow rate formula for a selected fuel injection nozzle as a function of fuel pressure and injector control valve on-time;

operating the selected fuel injection nozzle for a period of time;

measuring fuel pressure and injector control valve on-time of the fuel injection nozzle during operation;

determining the expected fuel flow rate for the measured fuel pressure and injector control valve on-time based on the created fuel flow rate formula;

measuring an actual fuel flow rate of the fuel injection nozzle during operation;

determining a coking condition of the fuel injection nozzle based on a difference between the actual fuel flow rate and the expected fuel flow rate; and altering the injector control valve on-time to compensate for deterioration in the actual fuel flow rate.

2. The method of claim 1, wherein the step of measuring an actual fuel flow rate comprises the step of attaching a flow rate sensor to the fuel injection system and monitoring a sensed flow rate of the fuel.

3. The method of claim 1, wherein the step of creating an expected fuel flow rate formula is done empirically.

4. The method of claim 1, wherein the step of altering the injector control valve on-time is automatic.

5. The method of claim 4, wherein the step of altering the injector control valve on-time comprises increasing the on-time.

6. The method of claim 1, further comprising the step of allowing the injection nozzle to become coked during the step of operating the injection nozzle.

7. The method of claim 1, wherein the expected fuel flow rate formula is part of an engine control strategy.

8. The method of claim 7, wherein the step of altering the injector control valve on-time is part of the engine control strategy.

9. The method of claim 1, wherein the step of altering the injector control valve on-time is part of an engine control strategy.

10. A fuel injection system comprising:

a fuel source;

a fuel injection nozzle fed by the fuel source and discharging fuel at an initial flow rate to an engine cylinder;

a control valve connected between the fuel source and the injection nozzle and capable of opening and closing to control the delivery of fuel to the injection nozzle;

a fuel flow rate sensor for determining an actual fuel flow rate through the nozzle to the engine cylinder;

a pressure sensor for measuring the pressure of the fuel before being injected through the nozzle into the engine cylinder;

a control valve on-time sensor for measuring the time an injector valve is open during each injection of fuel to the engine cylinder; and a control circuit electronically connected to each of the fuel flow sensor, pressure sensor, the control valve on-time sensor and the control valve;

wherein the control circuit alters the control valve on-time when the actual fuel flow rate is different than an expected fuel flow rate based on the measured fuel pressure and measured control valve on-time.

11. The fuel injection system of claim 10, wherein the fuel injection nozzle comprises a high-efficiency nozzle.

12. The fuel injection system of claim 10, wherein the control circuit comprises an engine control strategy having an empirically determined expected fuel flow rate formula for the fuel injection nozzle.

13. The fuel injection system of claim 12, wherein the expected fuel flow rate formula for the fuel injection nozzle is a function of fuel pressure and injection nozzle control valve on-time.

14. The fuel injection system of claim 12, wherein the control circuit further comprises a comparator for comparing the actual fuel flow rate to the expected fuel flow rate.

15. The fuel injection system of claim 11, wherein the high-efficiency fuel injection nozzle is susceptible to coking.

16. The fuel injection system of claim 10, wherein a difference between the actual fuel flow rate and the expected fuel flow rate is a result of nozzle coking.

17. A method for creating a fuel injection nozzle control strategy comprising the steps of:

selecting a fuel injection nozzle configuration to be controlled;

determining expected fuel flow rate for the selected fuel injection nozzle as a function of fuel pressure and injector control valve on-time;

operating the selected fuel injection nozzle for a period of time;

measuring fuel pressure and injector control valve on-time of the fuel injection nozzle during operation;

measuring the actual fuel flow rate of the fuel injection nozzle during operation;

determining a coked nozzle condition of the fuel injection nozzle based on the measured actual fuel flow rate; and altering the injector control valve on-time to compensate for the coked nozzle.

18. The method of claim 17, wherein the steps of calculating any difference and altering the injector control valve on-time are performed by an engine control circuit.

19. The method of claim 17, wherein the step of determining expected fuel flow rate is empirical.

20. The method of claim 17, wherein the step of determining a coked nozzle condition comprises the step of calculating any difference between the actual fuel flow rate and the expected fuel flow rate corresponding to the measured fuel pressure and injector control valve on-time for the fuel injection nozzle.

21. The method of claim 20, wherein the step of altering the injector control valve on-time is responsive to any calculated difference between the actual fuel flow rate and the expected fuel flow rate.

22. A method for creating a fuel injection nozzle control strategy comprising the steps of:

selecting a fuel injection nozzle configuration to be controlled;

determining expected fuel flow rate for the selected fuel injection nozzle as a function of fuel pressure and injector control valve on-time;

operating the selected fuel injection nozzle for a period of time;

measuring fuel pressure and injector control valve on-time of the fuel injection nozzle during operation;

measuring the actual fuel flow rate of the fuel injection nozzle during operation;

calculating any deficit in the actual fuel flow rate compared to the expected fuel flow rate corresponding to the measured fuel pressure and injector control valve on-time for the fuel injection nozzle; and increasing the injector control valve on-time to compensate for any calculated deficit in the actual fuel flow rate.

* * * * *